United States Patent [19]

Belanger

[11] Patent Number: 4,615,794

[45] Date of Patent: Oct. 7, 1986

[54] METHOD OF REMOVING RADIOACTIVE WASTE FROM OIL

[76] Inventor: Roger L. Belanger, P.O. Box 187, White Horse Beach, Mass. 02381

[21] Appl. No.: 642,400

[22] Filed: Aug. 20, 1984

[51] Int. Cl.[4] ..... C10M 175/00

[52] U.S. Cl. ..... 208/181; 208/183; 208/188; 208/251 R; 210/724; 210/737; 210/756; 210/774; 210/778; 210/806; 252/631; 252/635

[58] Field of Search ..... 208/179, 181–183, 208/187, 188, 190, 251 R; 210/682, 721, 724, 737, 756, 774, 777, 778, 805, 806; 252/626, 631, 632, 635; 423/11

[56] References Cited

U.S. PATENT DOCUMENTS 3,764,553 10/1973 Kirby ..... 210/724
3,923,643 12/1975 Lewis et al. ..... 208/179
4,431,524 2/1984 Norman ..... 208/182

FOREIGN PATENT DOCUMENTS 52-36872 9/1977 Japan ..... 210/737
53-143900 12/1978 Japan ..... 210/682

OTHER PUBLICATIONS

Chemical Abstract 96:26227m "Purification of Radioactive Oil," Soviet Union Patent 784,592, 9/7/81.

*Primary Examiner*—Peter Hruskoci
*Attorney, Agent, or Firm*—John P. McGonagle

[57] ABSTRACT

A method of removing radioactive waste from oil in which all particulates, radioactive contaminants, and moisture are removed from the oil. Particulate matter is removed from the oil by a combination of filtering and heating. Radioactive contaminants are reacted with chlorine to form salts which are removed by filtration. Moisture is removed by use of a flash tank.

10 Claims, 1 Drawing Figure

METHOD OF REMOVING RADIOACTIVE WASTE FROM OIL

BACKGROUND OF THE INVENTION

This invention relates to a method of purifying oil, and more particularly to a method of removing radioactive waste contaminants from lubricating oil.

Nuclear power plants, nuclear fuel reprocess facilities, and other types of facilities which handle radioactive material have serious problems in disposing of radioactive contaminated wastes such as lubricating oils, solvents, and antifreeze.

Lubricating oils are used in many areas of a nuclear power plant. They can be easily contaminated. Any spillage or leakage of lubricating oils from areas such as the turbine oil systems or feed water pumps goes to sumps and other drainage systems. The oil mixes with water and other contaminants from the nuclear reactor systems. Thus the lubricating oil becomes contaminated with radioactive wastes as well as dirt and moisture. Although the oil and water are not themselves radioactive, the other contaminants make the entire mixture radioactive.

The method most commonly used today by the nuclear industry to dispose of radioactive waste is to solidify and bury it. With oil based radioactive wastes emulsifiers and Portland cement are used to solidify the waste. This method of solidifying is acceptable to the Nuclear Regulatory Commission (NRC), but the process increases radioactive waste volume three to four times. Using this method on oil, one barrel of liquid oil will produce three to four barrels of solid waste. With the burial ground space allocation for radioactive waste decreasing so rapidly, a waste volume increase from one to four is barely tolerable. Another drawback with solidifying oil based waste is that the end product of the solidifying process is not guaranteed to be disposable. Oil mixtures often resist solidification even with emulsifiers.

What is needed is a way of reducing the end volume of processed radioactive waste. One way to do this for contaminated oil is to remove the actual radioactive contamination and processing it instead of treating the contamination plus the oil as radioactive waste.

The present invention offers a solution to the problem of increased volume when processing radioactive waste. The present invention is a method for removing radioactive contaminants from liquid radioactive wastes such as waste oil and reducing the radioactive waste volume by approximately 400 to 1. The radioactive waste resulting from this process is oil free and can be easily treated by the standard radioactive waste processing system. The resulting oil non-radioactive and can be recycled or used as fuel.

In one application of the present invention 660 gallons of radioactive contaminated waste oil was purified leaving a radioactive waste residue of 1.5 gallons of dry waste. The purified oil was radioactive-free as presently defined by the NRC.

Accordingly, an object of this invention is to provide a new method of removing radioactive contaminants from waste oil.

Another object of this invention is to provide a method of reducing radioactive waste volume in the processing of radioactive waste oil.

A more specific object of this invention is to provide a new method of removing radioactive pollutants from waste oil which includes removing particulates with heating and filtering, converting the remaining pollutants into salts, removing water from the oil, and filtering out all salts.

Other objects and advantages of the present invention will be apparent from a further reading of the specification and of the appended claims.

BRIEF DESCRIPTION OF THE DRAWING

The accompanying drawing shows, by way of example, one embodiment of the invention wherein.

DETAILED DESCRIPTION OF THE INVENTION

Figure 1:
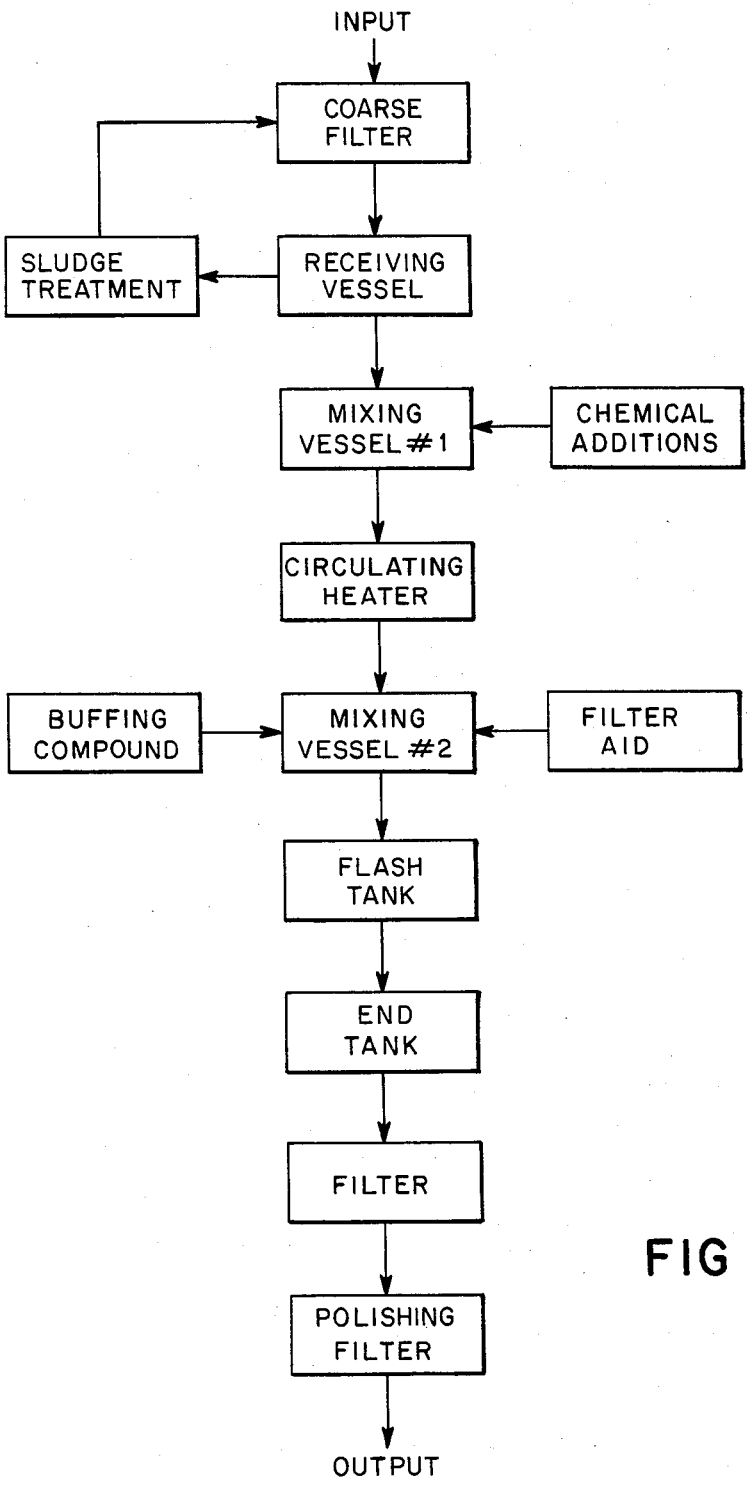
FIG. 1 is a flow sheet describing a complete method of operation including all stages for the removal of radioactive wastes from oil.

Waste oil from nuclear power plants may contain some or all of the following radioactive pollutants in a particulate, dissolved or gaseous state: Argon (Ar), Iodine (I), Krypton (Kr), Xenon (Xe), Cobolt (Co), Copper (Cu), Iron (Fe), Magnesium (Mg), Manganese (Mn), Molybdenum (Mo), Zinc (Zn), Cesium (Cs), Cerium (Ce), and Silver (Ag). These contaminants are primarily found in the moisture within the waste oil. However, in order to purify and reuse the waste oil as a lubricant or as a fuel, these pollutants must be removed, as must all moisture.

In the present invention, the contaminated oil is transferred to a receiving vessel through a coarse filter which removes high density particulate matter in excess of 0.25 inch body size. The top two-thirds of the receiving vessel is heated. As the oil is heated, the hotter oil moves to the top of the receiving vessel. As the oil temperature at the top of the receiving vessel rises to a temperature range of 150° to 200° F., it is skimmed off. Initial separation of some pollutants will also occur in this temperature range. Argon, Iodine, Krypton and Xenon will evaporate. Much of the remaining contaminants and particulate matter will precipitate forming a sludge in the lower half of the receiving vessel.

The sludge is removed to another container and, in a separate step, is heated to a temperature range of 212° to 225° F. for three to five hours and then cooled to 100° F. This process separates additional oil from the mud, particulates and water contained in the sludge. The separated oil is removed from the container and transferred back to the receiving vessel through the coarse filter for processing with, or as if it were, newly inputted contaminated oil.

Meanwhile, the oil which had been previously skimmed off the receiving vessel has been transferred to a mixing vessel for chemical treatment. The mixing vessel is stirred at an approximate 950 revolution per minute rate. Calcium Hypochlorite (CaOCl) crystals containing 65% free Chlorine (Cl) is added to the mixing vessel at a rate of one-half quart of crystals per fifty gallons of oil. The oil and crystals are mixed for approximately ten minutes and then transferred to a circulating heater. Although in this embodiment of the invention Calcium Hypochlorite crystals are used, Sodium Hypochlorite could also be used instead. A Magnesium Sulfate supplement, at a rate of one-quarter pound per fifty gallons of oil, may also be used in either situation. However, the Calcium Hypochlorite, by itself, is the safest and easiest to handle.

The circulating heater is set to bring the temperature of the mixture up to 300° F. As the Calcium Hypochlorite crystals are heated to a temperature range of 250° to 300° F. they dissolve and Chlorine gas ($Cl_2$) is released. The heater is kept at 30 PSIG pressure to keep the Chlorine gas in the mixture. The moisture in the mixture absorbs the Chlorine gas. The Chlorine attacks the radioactive contaminants in the moisture and begins the initial reactions to form salts with the contaminant elements.

The circulating heater outputs to a second mixing tank whose contents are further heated to 375° F. The output of the circulating heater maintains motion in the second mixing tank and, through this mixing action, the Chlorine and elements remain in suspension and solution. A pH buffering compound, such as Sodium Bicarbonate, is added to the oil mixture as it flows within the second mixing tank. This has a dual effect. When the Sodium Bicarbonate comes in contact with the moisture which holds the radioactive contaminants, the pH of the mixture of dissolved solid is elevated to a point where the contaminants become salts in solid form. Chemically, the reactions can be described as follows:

$$Ag + Co + Ce + Cs + Cu + Fe + Mg + Mn + Mo + Zn +$$

$$CaCl + Cl_2 \longrightarrow AgCl + CoCl_2 + CeCl_2 + CsCl + CuCl_2 +$$

$$FeCl_2 + MgCl_2 + MnCl_2 + MoCl_2 + ZnCl_2 + CaCl + Cl_2$$

At the same time the Sodium Bicarbonate is being dissolved and absorbed by the moisture, carbonation occurs. This is important because the moisture, due to its higher specific gravity, is primarily beneath the oil. The carbonation brings the moisture to the surface of the mixture. The entire mixture is then circulated through a flash tank heated to a minimum of 375° F. at 27 inches of mercury vacuum. The carbonated moisture, less salts, is quickly evacuated as is any excess Chlorine from the previous stage. The oil is now moisture free. The salts that were dissolved by the moisture return to a solid form trapping in other radioactive contaminants precipitated during this cycle. Excess Sodium Bicarbonate returns to its original state. The flash tank then outputs to an end tank which is maintained at 375° F.

The last stage is a filtration stage. The oil is passed through a one micron size filter made of ground shell. A ground shell filter aid is added to the second mixing tank prior to its contents passing through the flash tank. After the flash tank outputs to an end tank, the contents of the end tank are passed through a filter formed by the crushed shell over twelve micron paper. The effective filter size of the crushed shell over paper is one micron. This filter takes out the salts, excess Calcium Hypochlorite, Sodium Bicarbonate and any other remaining particulates to a one micron size. The oil is then passed through a polishing filter made of submicron filter in order to remove superfine particulates of contaminant. The oil is now contaminate free. The contaminants which were removed from the oil are ready for disposal.

It is understood that the above-described embodiment is merely illustrative of the application. Other embodiments may be readily devised by those skilled in the art which will embody the principles of the invention and fall within the spirit and scope thereof.

I claim:

1. A method of removing particulates, radioactive contaminants, and moisture from oil, which comprises the following steps:

straining out said particulates by passing the oil through a coarse filter screen to a receiving vessel;

forming an upper stratum of oil and a lower stratum of sludge, consisting of mud, oil, particulates, and moisture, by heating the upper two-thirds of the receiving vessel to a temperature range of 150° to 200° F.;

skimming off the stratum of oil from the receiving vessel;

transferring the sludge from the receiving vessel to a container;

extracting additional oil from the sludge by heating the container to a temperature range of 212° to 225° F. for three to five hours and then cooling the container to approximately 100° F.;

transferring the additional separated oil to the receiving vessel;

conveying the oil skimmed from the receiving vessel to a mixing vessel;

adding an effective amount of Calcium Hypochlorite crystals containing 65% free Chlorine to the mixing vessel to initiate salt formation with the radioactive contaminants;

mixing the contents of the mixing vessel for at least ten minutes;

transferring the mixture from the mixing vessel to a circulating heater;

heating the mixture to 300° F.;

outputting the mixture from the circulating heater to a second mixing vessel;

heating the contents of the second mixing vessel to 375° F.;

adding an effective amount of a carbonated pH buffering compound to the second mixing vessel to convert said radioactive contaminants into solid salts;

removing moisture from the oil; and filtering from the oil, the solid radioactive contaminant-salts and residual particulate matter.

2. A method of removing particulates, radioactive contaminants, and moisture from oil, as recited in claim 1, wherein:

the Calcium Hypochlorite crystals are added at a rate of one-half quart per fifty gallons of oil.

3. A method of removing particulates, radioactive contaminants, and moisture from oil, as recited in claim 2, wherein:

the pH buffering compound is Sodium Bicarbonate.

4. A method of removing particulates, radioactive contaminants, and moisture from oil, as recited in claim 3, wherein the moisture removal step is performed by:

circulating the contents of the second mixing vessel through a flash tank heated to a minimum of 375° F. at 27 inches of mercury vacuum.

5. A method of removing particulates, radioactive contaminants, and moisture from oil, as recited in claim 4, wherein the filtering step is performed by:

adding a filter aid to the second mixing vessel prior to circulating its contents through the flash tank;

outputting the contents of the flash tank to an end vessel heated to 375° F.;

passing the contents of the end tank through a one micron filter formed by the filter aid and a twelve micron paper filter; and passing the filtered output through a polishing filter made of submicron filter paper.

6. A method of removing particulates, radioactive contaminants, and moisture from oil, as recited in claim 5, wherein:

the filter aid consists of ground shell.

7. A method of removing particulates, radioactive contaminants, and moisture from oil, as recited in claim 6, further comprising:

adding Magnesium Sulfate to the mixing vessel prior to mixing at a rate of one-quarter pound per fifty gallons of oil.

8. A method of removing particulates, radioactive contaminants, and moisture from oil, which comprises the following steps:

straining out said particulates by passing the oil through a coarse filter screen to a receiving vessel;

forming an upper stratum of oil and a lower stratum of sludge, consisting of mud, oil, particulates, and moisture, by heating the upper two-thirds of the receiving vessel to a temperature range of 150° to 200° F.;

skimming off the stratum of oil from the receiving vessel; transferring the sludge from the receiving vessel to a container;

extracting additional oil from the sludge by heating the container to a temperature range of 212° to 225° F. for three to five hours and then cooling the container to approximately 100° F.;

transferring the additional separated oil to the receiving vessel;

conveying the oil skimmed from the receiving vessel to a mixing vessel;

adding an effective amount of Sodium Hypochlorite to the mixing vessel to initiate salt formation with the radioactive contaminants;

mixing the contents of the mixing vessel for at least ten minutes;

transferring the mixture from the mixing vessel to a circulating heater;

heating the mixture to 300° F.;

outputting the mixture from the circulating heater to a second mixing vessel;

heating the contents of the second mixing vessel to 375° F.;

adding an effective amount of a carbonated pH buffering compound to the second mixing vessel to convert said radioactive contaminants into solid salts;

removing moisture from the oil; and filtering from the oil, the solid radioactive contaminant-salts and residual particulate matter.

9. A method of removing particulates, radioactive contaminants, and moisture from oil, as recited in claim 8, wherein:

the Sodium Hypochlorite is added to the mixing vessel at a rate of one-half quart per fifty gallons of oil.

10. A method of removing particulates, radioactive contaminants, and moisture from oil, as recited in claim 9, further comprising:

adding Magnesium Sulfate to the mixing vessel prior to mixing at a rate of one-quarter pound per fifty gallons of oil.

* * * * *